US010407848B2

(12) United States Patent
Hogan et al.

(10) Patent No.: US 10,407,848 B2
(45) Date of Patent: Sep. 10, 2019

(54) SYSTEM AND METHOD FOR CONTROLLING PROPORTION OF LIQUID IN SUBSTRATE MATERIAL WORKED BY MACHINE

(71) Applicant: Caterpillar Paving Products Inc., Brooklyn Park, MN (US)

(72) Inventors: Lee Hogan, Varna, IL (US); Matthew Frantz, Shakopee, MN (US); Jason Muir, Andover, MN (US); Brian Schlenker, Shoreview, MN (US); Timothy O'Donnell, Long Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 306 days.

(21) Appl. No.: 15/226,720

(22) Filed: Aug. 2, 2016

(65) Prior Publication Data

US 2018/0038057 A1 Feb. 8, 2018

(51) Int. Cl.
*E01C 23/06* (2006.01)
*E01C 21/00* (2006.01)

(52) U.S. Cl.
CPC ..... *E01C 23/065* (2013.01); *E01C 21/00* (2013.01)

(58) Field of Classification Search
CPC ..... E01C 23/065
See application file for complete search history.

(56) References Cited

U.S. PATENT DOCUMENTS

| | | | | |
|---|---|---|---|---|
| 4,315,421 | A | 2/1982 | Wilson | |
| 6,623,207 | B2 | 9/2003 | Grubba | |
| 7,896,258 | B2 | 3/2011 | Hoisington | |
| 8,202,021 | B2 | 6/2012 | Gorman | |
| 8,668,274 | B2 | 3/2014 | Gaertner | |
| 8,956,076 | B2 | 2/2015 | Menzenbach | |
| 9,103,079 | B2 | 8/2015 | Schlenker | |
| 2004/0095154 | A1 | 5/2004 | Lundstrom | |
| 2009/0224084 | A1* | 9/2009 | Hoisington | A01B 79/005 239/754 |
| 2012/0043401 | A1 | 2/2012 | Heusinger | |
| 2012/0063845 | A1* | 3/2012 | Vitale | A01B 77/00 404/76 |
| 2016/0053446 | A1 | 2/2016 | Killtion | |

FOREIGN PATENT DOCUMENTS

| | | |
|---|---|---|
| CN | 102146209 | 8/2011 |
| JP | 2010284624 | 12/2010 |
| WO | 2015103908 | 7/2015 |

* cited by examiner

*Primary Examiner* — Christian Chace
*Assistant Examiner* — Jordan S Fei
(74) *Attorney, Agent, or Firm* — Mattingly Burke Cohen & Biederman

(57) ABSTRACT

A machine includes a material working mechanism movable relative to a frame to vary working depth of the material working mechanism. A control system monitors certain parameters, and controls a liquid dispensing mechanism to control application of a liquid such as water or an emulsion to be applied to material being worked by the material working mechanism based upon the parameters. The control system functions to produce a desired proportion of the liquid such as a liquid percent density in worked material.

19 Claims, 3 Drawing Sheets

SYSTEM AND METHOD FOR CONTROLLING PROPORTION OF LIQUID IN SUBSTRATE MATERIAL WORKED BY MACHINE

TECHNICAL FIELD

The present disclosure relates generally to controlling the application of liquid to a material of a substrate being worked by a machine, and relates more particularly to controlling a proportion of liquid in worked material based upon working depth and ground speed of the machine.

BACKGROUND

Tractors equipped with various implements, pavers, compactors, graders, scrapers, and other types of machines are used for modifying substrate material or preparing a substrate for various uses. In the paving context, machines known in the art as cold planers are used to remove an upper layer of paving material often in preparation for placement of a substitute paving material mat. A cold planer is typically equipped with a rotor that breaks paving material into chunks of manageable size, and conveys the removed paving material to a truck for disposal or other use such as for fill material.

Recent decades have seen increased interest in in situ processing and reuse of paving material. Most persons will be familiar with the undesirability of cracked, uneven, and/or potholed road and parking lot surfaces. The economy of reusing paving material in place, without removing it and transporting it elsewhere, will also be apparent to most. So-called recyclers or mixers are in increasing use throughout the world for preparing a new substrate to support a new traffic-bearing paving material mat. In general, a recycler or rotary mixer breaks apart old paving material and mixes the chunks of paving material with underlying substrate, typically soil, to produce a new substrate upon which a new traffic-bearing surface such as for a road or parking lot can be placed. Certain challenges have been observed with recyclers or rotary mixers in relation to achieving a desired composition of the mixed material once processed. Commonly owned U.S. Pat. No. 8,794,869 to Schlenker et al. is directed to a rotary mixer having a rotor chamber that receives a first surface and produces a reclaimed surface. An electronic control module is coupled to a rotor chamber and particle sensor and adjusts a degree of pulverization of reclaimed surface according to a difference between a detected particle size and a desired particle size.

SUMMARY OF THE INVENTION

In one aspect, a machine for working material of a substrate includes a frame and ground-engaging elements coupled to the frame. The machine further includes a material working mechanism movable relative to the frame among a plurality of different configurations to work material of the substrate at a plurality of different working depths. The machine also includes a liquid delivery mechanism configured to dispense a liquid to the material being worked by the material working mechanism, and a control system for controlling the liquid delivery mechanism. The control system includes a first monitoring mechanism configured to monitor a first parameter indicative of a ground speed of the machine, a second monitoring mechanism configured to monitor a second parameter indicative of a configuration of the plurality of configurations of the material working mechanism, and a control mechanism. The control mechanism is coupled with the liquid delivery mechanism and configured to control a proportion of the liquid in the material worked by the material working mechanism at least in part by varying a liquid output of the liquid delivery mechanism based upon the ground speed and the configuration of the material working mechanism indicated by the first parameter and the second parameter, respectively.

In another aspect, a system for controlling an amount of liquid and material of a substrate worked by a machine includes a first monitoring mechanism configured to monitor a first parameter indicative of a ground speed of the machine, and a second monitoring mechanism configured to monitor a second parameter indicative of a configuration of a material working mechanism of a machine, wherein the material working mechanism is movable among a plurality of different configurations for working material of a substrate at a plurality of different working depths. The system still further includes a control mechanism coupled with each of the first monitoring mechanism and the second monitoring mechanism and configured to control a proportion of dispensed liquid in material worked by the material working mechanism. The control mechanism is further configured to control the proportion at least in part by producing a control command for a liquid delivery mechanism positioned to dispense a liquid to a material being worked by the material working mechanism, and wherein the control command is based upon the ground speed and the configuration of the material working mechanism indicated by the first parameter and the second parameter, respectively.

In still another aspect, a method of controlling a proportion of a liquid in material of a substrate worked by a machine includes operating the machine at a first combination of ground speed and working depth of a material working mechanism of the machine, and dispensing a liquid to material of the substrate being worked by the material working mechanism at a first flow rate to produce a desired proportion of the liquid in the material after working. The method further includes operating the machine at a second combination of ground speed and working depth of the material working mechanism, and dispensing the liquid to material of a substrate being worked by the material working mechanism at a second flow rate different from the first flow rate to produce the desired proportion of the liquid in the material after working.

DETAILED DESCRIPTION

Figure 1:
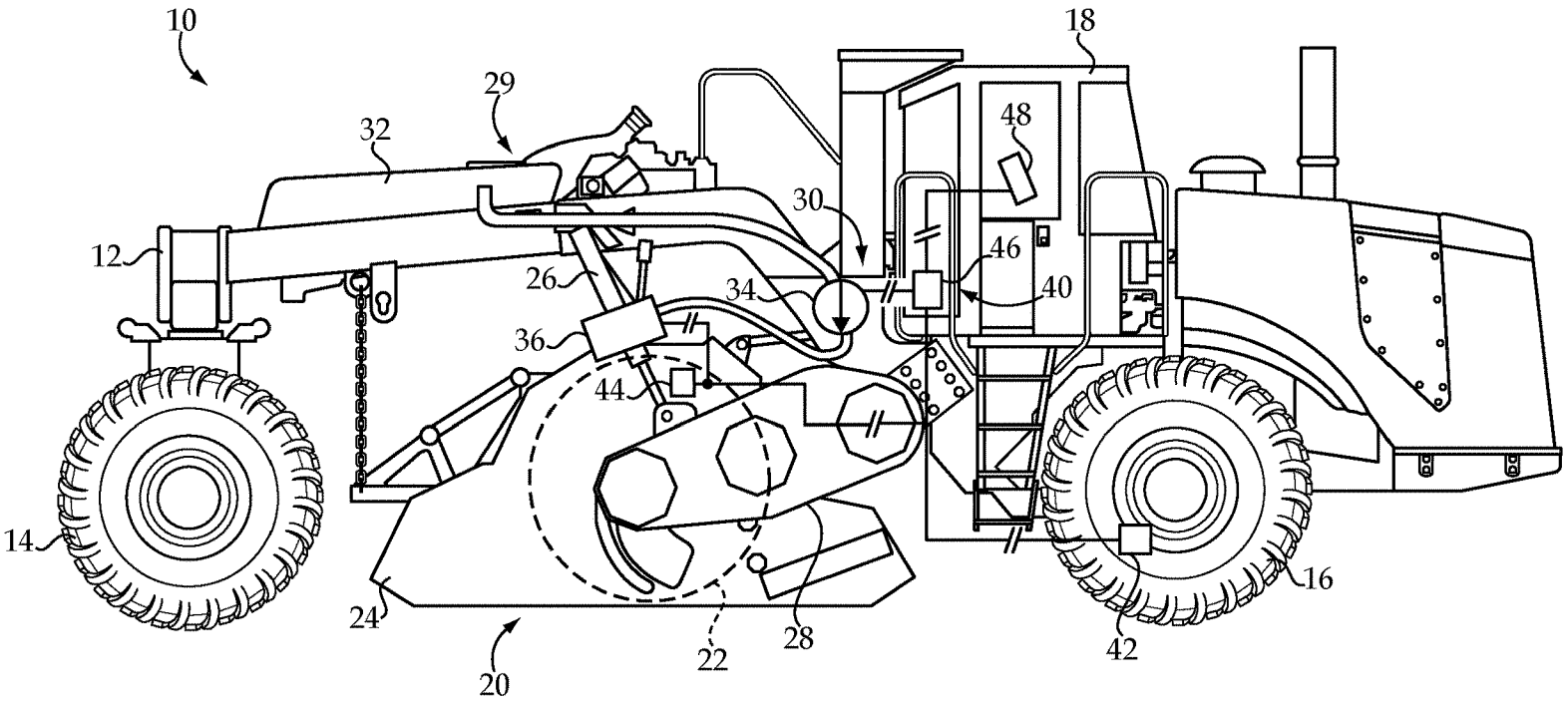
FIG. 1 is a side diagrammatic view of a machine, according to one embodiment.

Referring to FIG. 1, there is shown a machine 10 for working material of a substrate. As further described herein, the material of the substrate may include a combination of paving material including asphalt and aggregate, and material underlying the paving material that may include soil, aggregate, and/or other materials as the case may be. The present disclosure is not limited to any particular type or composition of material worked, however, paving material and soil to be mixed together are one practical implementation strategy. Machine 10 may include a frame 12 having a front set of ground-engaging elements 14 and a back set of ground-engaging elements 16 coupled to frame 12. In the illustrated embodiment, ground-engaging elements 14 and 16 may include ground-engaging wheels. A material working mechanism 20 (hereinafter mechanism 20) is movable relative to frame 12 among a plurality of different configurations to work material of the substrate at a plurality of different working depths. Machine 10 may further include a cab 18 supported by frame 12 and including therein operator controls, certain of which are further described herein. In some embodiments, machine 10 could include an open operator platform, or could potentially even be an autonomous machine. Mechanism 20 can include a rotor 22 positioned within a housing 24 that is supported vertically below frame 12 between front set of ground-engaging elements 14 and back set of ground-engaging elements 16. The plurality of different configurations of mechanism 20 may include a first vertical position relative to frame 12 where rotor 22 is positioned to work material of the substrate at a first working depth, and a second vertical position relative to frame 12 where rotor 22 is positioned to work material of the substrate at a second working depth. Machine 10 further includes a liquid application system 29 that includes a liquid delivery mechanism 30 configured to dispense a liquid to material being worked by mechanism 20. Liquid delivery mechanism 30 (hereinafter mechanism 30) may include a tank 32 (supported by or provided on frame 12), a pump 34, and a sprayer 36 positioned to spray a liquid supplied by way of tank 32 to material being worked by mechanism 20, in a manner further discussed herein. As noted above, mechanism 20 and in particular rotor 22, can be vertically adjustable between a fully raised position and a plurality of lowered positions to vary a working depth of mechanism 20 relative to a substrate. One or more actuators 26 may be provided for vertically adjusting rotor 22 and/or other components of mechanism 20. A support bar 28 can be provided to support mechanism 20 at any of its vertical positions. In still other embodiments, a material working mechanism having similarities with mechanism 20 could be mounted in a different manner, at a different location, or associated with a different type of machine altogether. Thus, while machine 10 may be a rotary mixer of a general type manufactured by the assignee of the present patent application, the disclosure is not limited as such. Mechanism 20 could potentially even be a towed device in alternative implementations. The liquid dispensed by way of liquid delivery mechanism 30 can be water, or any of a variety of commercially available emulsions including water and a lubricant and/or asphalt and an emulsifier, for example, for the purpose of increasing a liquid content of material of the substrate during working by way of mechanism 20. Those skilled in the art will be familiar with variation in certain properties of soil and the like depending upon moisture content, or the content of another liquid. Among different soil types the desired or optimum liquid content for compaction and subsequent service as a support substrate for paving can vary. For instance, it has been observed that sandy soils, clayey soils, and soils high in organic matter can all respond differently to compactive efforts. Conventional practices for adjusting or controlling moisture content have included manual calculations, consultation of outside resources, as well as engineering judgment and guesswork. As will be further apparent from the following description, the present disclosure provides techniques for autonomously controlling apparatus of machine 10, namely, mechanism 30 to control dispensing of liquid to material being worked by mechanism 20 in a manner considered advantageous over conventional strategies.

To this end, machine 10 further includes a control system 40 for liquid delivery mechanism 30 that includes a first monitoring mechanism 42 configured to monitor a first parameter indicative of a ground speed of machine 10. The first monitoring mechanism 42 (hereinafter mechanism 42) may include a wheel speed sensor, a GPS receiver, ground radar, or any other suitable mechanism for directly or indirectly determining or estimating a ground speed of machine 10. Control system 40 further includes a second monitoring mechanism 44 configured to monitor a second parameter indicative of the configuration of mechanism 20. As discussed above, the configuration of mechanism 20 can include a vertical position. Accordingly, second monitoring mechanism 44 (hereinafter mechanism 44) could include a position sensor coupled with or positioned to monitor actuator 26, bar 28, or other features of mechanism 20 that move vertically as working depth is adjusted. Control system 40 still further includes a control mechanism 46 that may be coupled with mechanism 42 and mechanism 44 and structured to receive data from mechanism 42 and mechanism 44, or to interrogate mechanism 42 and mechanism 44, for example. No particular configuration or strategy whereby control mechanism 46 receives data from mechanism 42 and mechanism 44 is intended by way of the present description. Control mechanism 46 may include a computer having at least one data processor, and computer memory for storing suitable program instructions for executing to carry out the various functions of control system 40 as described herein. Control mechanism 46 is also coupled with a user input device such as a touch screen display 48 positioned, for instance, in operator cab 18. As further discussed herein, an operator can input various parameter values, including local soil or other substrate moisture, and control the functionality of control system 40 among two or more different available operating modes.

Control mechanism 46 is coupled with liquid delivery mechanism 30 and configured to control a proportion of dispensed liquid in material worked by mechanism 20. Control mechanism 46 controls the proportion at least in part by varying a liquid output of mechanism 30 based upon the ground speed and the configuration of mechanism 20 indicated by the first parameter and the second parameter, respectively. It will be recalled that configuration of mechanism 20 defines a working depth. Ground speed of machine 10 determines the rate at which mechanism 20 is moved forward through material of the substrate upon which machine 10 is traveling. Accordingly, it will be understood that a combination of working depth and ground speed determines a rate at which material is being worked by machine 10. One way to visualize the phenomenon is as a vertical footprint of rotor-to-material contact that varies with working depth and moves forward through material at a variable rate. Accordingly, these factors together determine how much material in a given time is being worked by mechanism 20, and the present disclosure reflects the insight that dispensing of liquid can be controlled based upon these factors to ultimately produce a desired proportion of liquid in the worked material. Since material not yet having been worked by mechanism 20 will have at least some moisture content, it will generally be desirable to determine local conditions of soil moisture or obtain information on local conditions and input that information to control system 40 prior to or perhaps even during operation. As noted above, a user such as an operator might manually input this information, although sensing equipment could be used to autonomously determine moisture content and setup control system 40 for operation accordingly.

Figure 2:
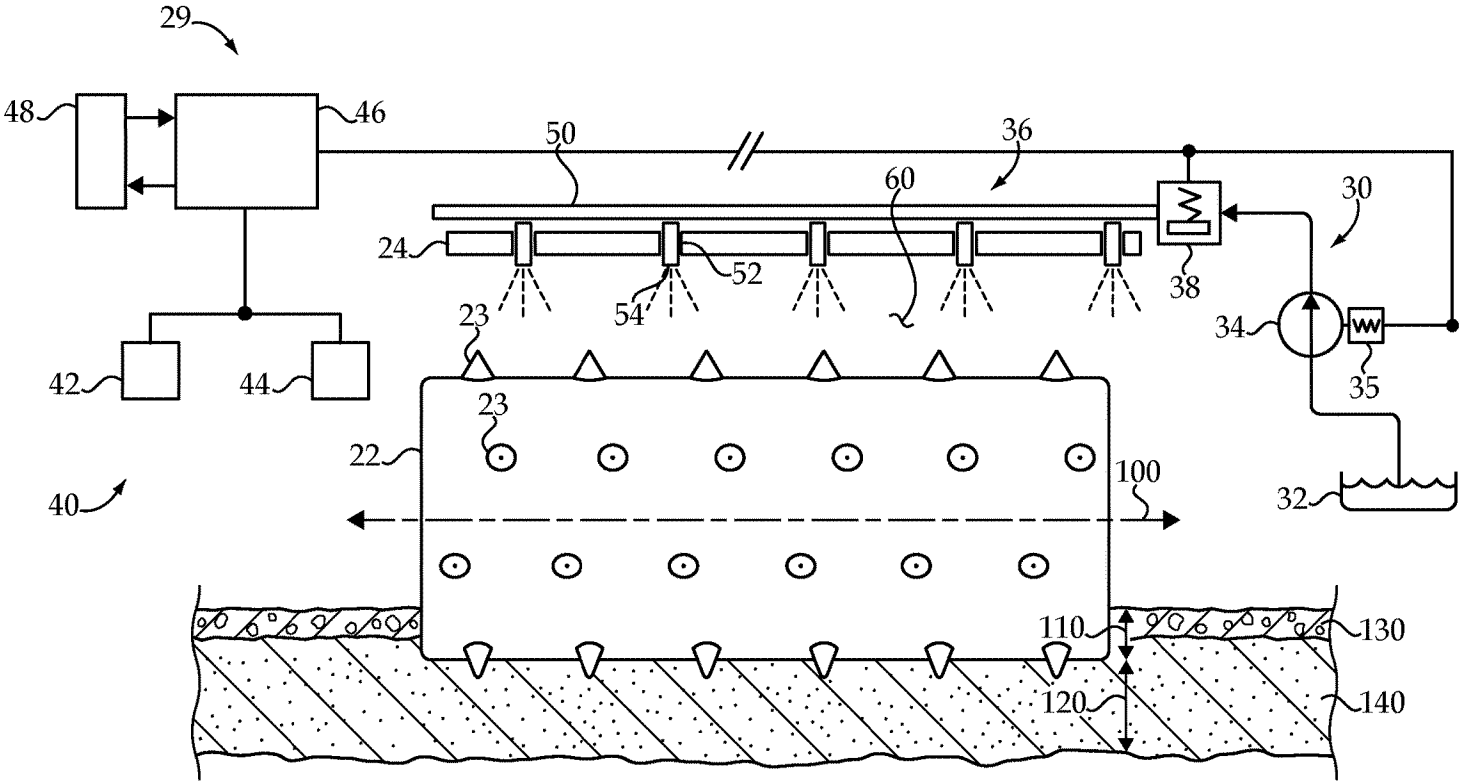
FIG. 2 is a diagrammatic view of portions of the machine of FIG. 1.

Referring also now to FIG. 2, there are shown additional features of liquid application system 29 in some further detail. In FIG. 2, rotor 22 is shown as it might appear positioned at a first working depth 110 to work material of a substrate in the nature of a single layer of paving material 130 placed upon an underlying material 140 such as soil, gravel, et cetera. Rotor 22 may rotate about an axis 100, producing counter-rotation relative to forward travel of machine 10. Rotor 22 may also be equipped with a plurality of teeth 23 or the like. Rotor 22 is also shown positioned within a chamber 60 formed by housing 24. As noted above, mechanism 30 can include a sprayer 36. Sprayer 36 may include a spray bar 50 having a plurality of spray nozzles 52. Spray nozzles 52 may extend through housing 24, approximately as shown, to position a spray outlet 54 of each nozzle 52 within housing 24 and thus chamber 60. A solenoid valve 38 is shown positioned fluidly between spray bar 50 and pump 34 to provide for a shutoff of liquid flow or an establishment of liquid flow for purposes consistent with the present disclosure and further discussed herein. Control mechanism 46 may be coupled with solenoid valve 38. A different type of electrically actuated valve could be used in other embodiments. Also shown in FIG. 2 is another solenoid valve 35 coupled with pump 34, and also coupled with control mechanism 46. During operation, system 30 may be used to provide liquid, such as water or emulsion, to be sprayed into chamber 60 for mixing with material being worked within chamber 60. When rotor 22 is adjusted to a different working depth, such as by lowering rotor 22 to a deeper working depth 120, and/or where ground speed is adjusted, mechanism 30 can be controlled by control system 40, to adjust liquid dispensing such as by increasing or decreasing a flow rate to maintain the desired proportion of liquid in the worked material. As suggested above, a moisture content of material being worked could be monitored in real time. Certain adjustments to operation could therefore be made in real time based upon a change in local soil moisture or soil type from place to place within a working area. It is also contemplated that mechanism 30 can be operated to stop dispensing liquid when machine 10 stops or slows below a certain ground speed. To this end, control mechanism 46 can be structured to disable liquid flow past electrically actuated solenoid valve 38 responsive to a ground speed indicated by the first parameter, in at least certain instances. In a practical implementation strategy, flow rate of liquid through or from mechanism 30 can be varied by controlling pump 34. Accordingly, control mechanism 46 may be configured to control the proportion of dispensed liquid in material worked by mechanism 20 at least in part by producing a control command for mechanism 30 in the form of a pumping speed command. Pump 34 might include or be coupled with an electric motor having an adjustable speed to vary pumping speed and therefore flow rate.

Control mechanism 46 may also be configured to calculate the liquid flow rate that will produce the desired proportion of dispensed liquid and material worked by mechanism 20. In one practical implementation, the proportion of dispensed liquid in material worked by mechanism 20 includes a liquid percent density. Specifications for various construction projects, including construction of traffic-bearing structures such as roads and parking lots, are commonly expressed in the form of a specified moisture or other liquid density percentage. The present disclosure therefore contemplates configuration of control system 40 to produce the desired proportion of dispensed liquid in a manner consistent with typical jurisdictional or industry practice standards, however, the present disclosure is not limited as such and in other embodiments a mass specification or potentially still another specification might be used. In any case, outputting a pumping command to pump 44 or associated apparatus to vary pumping speed is one practical implementation. In others, a constant pumping speed might be maintained at least most of the time, and excess liquid flow dumped back or otherwise returned to tank 32. Embodiments are also contemplated where spray nozzles 52 can be independently controlled, either by way of manual adjustments or by electrical actuators or the like. Accordingly, during operation, one or more of spray nozzles 52 might be closed. Control mechanism 46 may be configured to account for availability or non-availability of certain of spray nozzles 52 and therefore can determine the flow rate that is desired based upon a number of the plurality of spray nozzles 52 that are open.

In one embodiment, control mechanism 46 can calculate the desired flow rate by way of the following Equation 1:

$$\text{Desired Liquid Flow}\left(\frac{\text{L}}{\text{Min}}\right) = \frac{\left(\begin{array}{c}[\text{Rotor Depth(m)}] \times [\text{Rotor Width(m)}] \times \left[\left(\frac{\#\text{ of open spray nozzles}}{16}\right)\right] \times \\ \left[\text{Ground Speed}\left(\frac{\text{m}}{\text{min}}\right)\right]\left[\text{Ground Material Density}\left(\frac{\text{kg}}{\text{m}^3}\right)\right] \times \\ \left[\frac{\text{Desired Liquid Percent Soil Density(\%)}}{100}\right]\end{array}\right)}{\left(\begin{array}{c}\left[\text{Liquid Fluid Density}\left(\frac{\text{kg}}{\text{L}}\right)\right] \times \\ \left\{1 - \left[\frac{\text{Desired Liquid Percent Soil Density(\%)}}{100}\right]\right\}\end{array}\right)}$$

Figure 3:
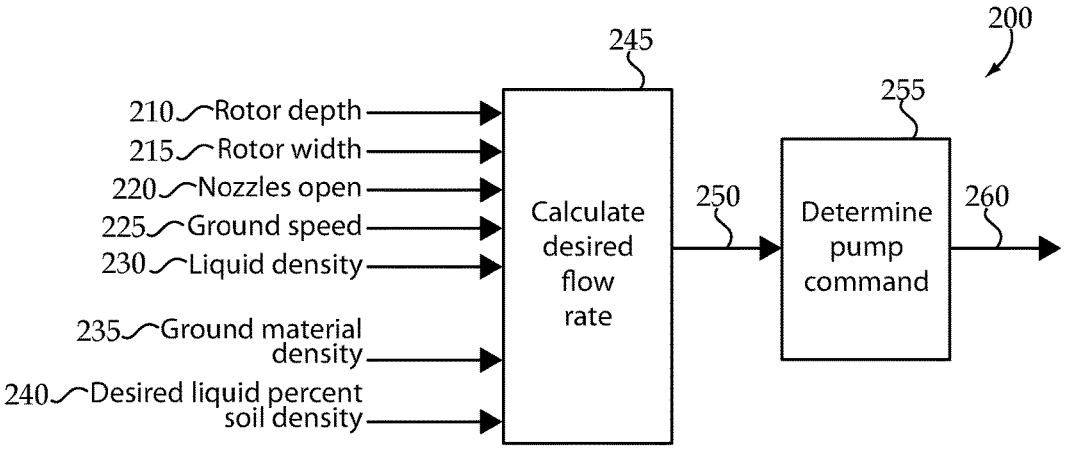
FIG. 3 is a computational block diagram, according to one embodiment.

As desired water spray flow rate, or emulsion spray flow rate, can continually change as ground speed and rotor depth change, control mechanism 46 can operate to calculate desired flow rate more or less continuously. Equation 1 is but one example equation, and it should therefore be appreciated that other mathematical combinations of the same or different factors can be used by control mechanism 46 to calculate the desired flow rate. Referring also to FIG. 3, there is shown a block diagram 200 where a first block 245 includes calculation of desired flow rate. The calculation of desired flow rate can take place on the basis of a number of fixed inputs, including rotor width 215 and water density 230. A rotor depth input 210 can vary based upon the value of the associated second parameter indicated by way of monitoring mechanism 44. As discussed above, a number of nozzles open, or a number of nozzles closed, is another input 220 that can vary. As described herein, a ground speed input 225 can also be expected to vary. Additional inputs for the calculation of block 245 can include ground material density 235 and desired liquid percent soil density 240, with inputs 235 and 240 being provided by way of display or user interface 48 (e.g., input by an operator of machine 10). The calculation at block 245 can produce a flow rate 250, according to the above equation. Another block 255 includes determination of a pump command, such as by way of a map. A plurality of pump commands could correspond to a plurality of pumping speeds, with the pump commands mapped to flow rates, for instance. Thus, once a desired flow rate is determined ECU 42 could look up the appropriate pump command from the map, or look up the appropriate pumping speed and determine an appropriate pump command to produce that pumping speed by any other suitable means. Rather than a pump command, embodiments are contemplated where block 255 might include a valve position command. Block 255 produces a control command 260, such as an electrical current, a voltage, et cetera. Actual water percent soil density, analogously applicable to an emulsion, may be calculated according to the following Equation 2:

$$\text{Liquid Percent Soil Density}(\%) = \left[\frac{\text{Liquid Mass}}{\text{Total Mass}}\right] = 100 \times \frac{[\text{Liquid Volume Added(L)}] \times \left[\text{Liquid Density}\left(\frac{\text{Kg}}{\text{L}}\right)\right]}{\left[\text{Liquid Volume Added(L)} \times \text{Liquid Density}\left(\frac{\text{Kg}}{\text{L}}\right)\right] + \left[\text{Soil Volume}(\text{m}^3) \times \text{Soil Density}\left(\frac{\text{Kg}}{\text{m}^3}\right)\right]}$$

INDUSTRIAL APPLICABILITY

As discussed above, there are certain conditions where water or emulsion spray will be turned off entirely. In at least some instances, control system 40 may be configured such that machine 10 must be moving to enable liquid spray at all. For instance, when ground speed exceeds a threshold speed (e.g., about 1.5 meters per minute), system 29 could be activated and could remain active until ground speed drops below another threshold speed (e.g., about 1 meter per minute). When ground speed is sufficient, pump 34 may seek to achieve and maintain the calculated desired flow rate and electrically actuated solenoid valve 38 may be maintained on. The pump command can be continually adjusted to achieve the calculated desired liquid flow rate. Without sufficient travel speed, electrically actuated solenoid valve 38 and solenoid 35 can both remain off. As discussed herein, however, a variety of different alternatives for this general control strategy are contemplated.

Figure 4:
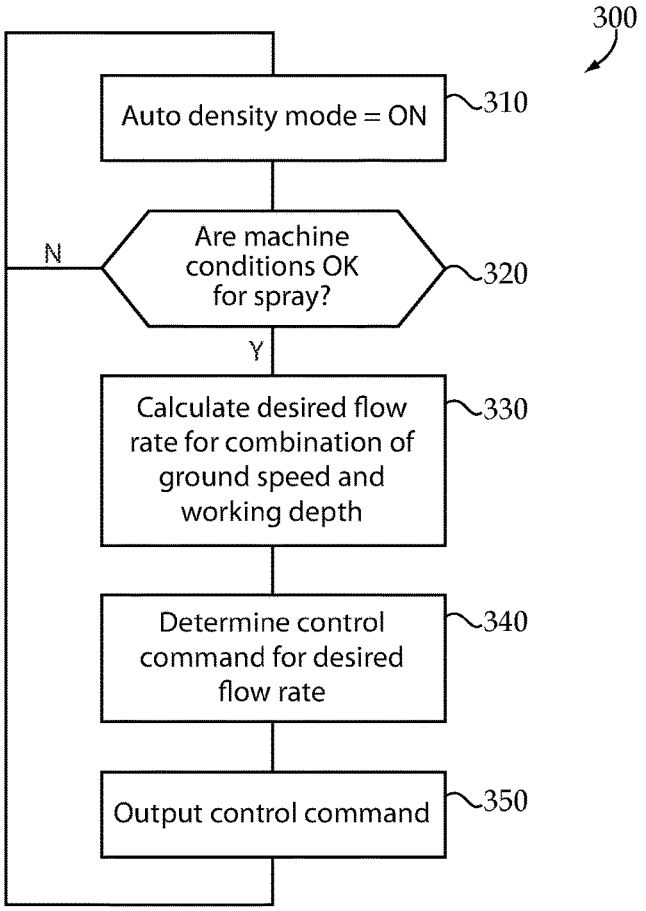
FIG. 4 is a flowchart illustrating a process, according to one embodiment.

Referring now also to FIG. 4, there is shown a flowchart 300 illustrating certain aspects of operation and control of machine 10 in the manner described herein. At block 310, auto density mode is ON, meaning that an operator selected autonomous control over soil moisture as described herein, from which point the logic can advance to block 320 to query are machine conditions OK for spray? The determination at block 320 can be understood to mean that a check is conducted to determine if there are conditions unfavorable for liquid spray, such as the machine being stopped, the liquid supply being depleted, a mechanical failure, or still other unfavorable conditions for spray. If no, from block 320 the logic could return or loop back, or could simply exit. If yes, the logic can advance to block 330 to calculate desired flow rate for the present observed combination of ground speed and working depth. As discussed herein, at any given time machine 10 may be operating at what can be considered a first combination of ground speed and working depth of mechanism 20. Liquid may be dispensed to material of the substrate being worked by mechanism 20 at a first flow rate to produce a desired proportion of the liquid in the material after working. From block 330 the logic can advance to block 340 to determine a control command for the desired flow rate as described herein. From block 340 the logic can advance to block 350 to output the determined control command, and could thenceforth loop back or exit. When the logic of flowchart 300 is executed again, machine 10 could be understood as operating at a second combination of ground speed and working depth of mechanism 20. Accordingly, the subsequent execution of the logic of flowchart 300 can result in dispensing the liquid to material of the substrate being worked by mechanism 20 at a second flow rate different from the first flow rate to produce the desired proportion of the liquid in the material after working.

It should be appreciated that the factors of ground speed and working depth can change separately or in parallel. In other words, control system 40 could operate to calculate a first flow rate based upon a first ground speed and a first working depth, and subsequently calculate a second flow rate based upon a second ground speed different from the first ground speed and a second working depth different from the first working depth. Alternatively, a first flow rate and a second flow rate could each be calculated based upon only one of those parameters of ground speed and working depth changing at any given time. It is also contemplated that ground speed could increase or decrease while working depth is increasing or decreasing so that the same flow rate could be used to produce the desired proportion of liquid in either case even though both of the parameters have changed. Pump and speed control demands of valve position commands could provide the desired changes in liquid application system 29.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A machine for working material of a substrate, the machine comprising:

a frame;

ground-engaging elements coupled to the frame;

a material working mechanism, movable relative to the frame among a plurality of different configurations, to work the material of the substrate at a plurality of different working depths, the plurality of different configurations including a first vertical position relative to the frame and a second vertical position relative to the frame, the second vertical position different from the first vertical position;

a liquid delivery mechanism configured to dispense a liquid to the material being worked by the material working mechanism; and a control system for controlling liquid delivery mechanism, the control system including a first monitoring mechanism configured to monitor a first parameter indicative of a ground speed of the machine, a second monitoring mechanism configured to monitor a second parameter indicative of a vertical position of the material working mechanism, and a control mechanism;

the control mechanism being coupled with the liquid delivery mechanism and being configured to control a proportion of the liquid in the material worked by the material working mechanism at least in part by varying a liquid output of the liquid delivery mechanism based upon the ground speed, indicated by the first parameter, and the configuration of the material working mechanism, indicated by the second parameter.

2. The machine of claim 1 wherein the liquid delivery mechanism includes a pump and the control mechanism is further configured to vary the liquid output of the liquid delivery mechanism by varying a pumping speed of the pump.

3. The machine of claim 1 wherein the proportion of the dispensed liquid, in the material worked by the material working mechanism, includes a liquid percent density.

4. The machine of claim 1 wherein the control mechanism is further configured to determine a liquid flow rate, based upon the configuration of the material working mechanism and the ground speed, and to output a pumping command to a pump in the fluid delivery mechanism to produce the liquid flow rate.

5. The machine of claim 1 further comprising a housing for the material working mechanism, and wherein the liquid delivery mechanism further includes a spray bar having a plurality of spray nozzles including spray outlets positioned within the housing.

6. The machine of claim 5 wherein the control mechanism is further configured to determine a liquid flow rate based upon a number of the plurality of spray nozzles that are open, the configuration of the material working mechanism, and the ground speed.

7. The machine of claim 1 wherein the material working mechanism includes a rotor, and in the first vertical position the rotor is positioned to work material of the substrate at a first working depth, and in the second vertical position the rotor is positioned to work material of the substrate at a second working depth.

8. The machine of claim 7 wherein the machine includes a rotary mixer having a housing for the rotor that is supported vertically below the frame between a front set of the ground engaging elements and a back set of the ground engaging elements.

9. A system for controlling an amount of liquid in material of a substrate worked by a machine, the system comprising:

a first monitoring mechanism configured to monitor a first parameter indicative of a ground speed of the machine;

a second monitoring mechanism configured to monitor a second parameter indicative of a configuration of a mated al working mechanism of the machine, wherein the material working mechanism is movable, relative to a frame of the machine, among a plurality of different vertical positions relative to the frame, for working material of a substrate at a plurality of different working depths; and a control mechanism coupled with each of the first monitoring mechanism and the second monitoring mechanism and being configured to control a proportion of liquid in material worked by the material working mechanism;

the control mechanism being further configured to control the proportion at least in part by producing a control command for a liquid delivery mechanism positioned to dispense a liquid to a material being worked by the material working mechanism, and wherein the control command is based upon the ground speed, indicated by the first parameter, and the vertical position of the material working mechanism, indicated by the second parameter.

10. The system of claim 9 wherein the relative proportion includes a liquid percent density.

11. The system of claim 10 further comprising the liquid delivery mechanism, and wherein the liquid delivery mechanism includes a pump and the control command includes a pumping speed command.

12. The system of claim 11 wherein the liquid delivery mechanism further includes a spray bar coupled with the pump.

13. The system of claim 11 wherein the control mechanism is further configured to calculate a liquid flow rate to produce the percent density, and to determine the pumping speed command based upon the liquid flow rate.

14. The system of claim 13 wherein the control mechanism is further configured to calculate the liquid flow rate based upon an input received from a user input device that is indicative of a density of the material of the substrate to be worked.

15. The system of claim 13 wherein the liquid delivery mechanism includes an electrically actuated valve, and the control mechanism is further structured to disable liquid flow past the electrically actuated valve responsive to a ground speed indicated by the first parameter.

16. A method of controlling a proportion of a liquid in material of a substrate worked by a machine, the method comprising:

operating the machine at a first combination of ground speed and working depth of a material working mechanism of the machine;

dispensing a liquid to material of the substrate being worked by the material working mechanism at a first flow rate to produce a desired proportion of the liquid in the material after working;

calculating the first flow rate based upon a first ground speed and a first working depth;

operating the machine at a second combination of ground speed and working depth of the material working mechanism;

dispensing the liquid to material of the substrate being worked by the material working mechanism at a second flow rate different from the first flow rate to produce the desired proportion of the liquid in the material after working; and calculating the second flow rate based upon a second ground speed different from first ground speed and a second working depth different from the first working depth.

17. The method of claim 16 wherein the desired proportion of the liquid includes a desired percent density.

18. The method of claim 17 further comprising calculating each of the first flow rate and the second flow rate, and producing a first pumping speed control command and a second pumping speed control command for a pump in the liquid dispensing mechanism that are based upon the first flow rate and the second flow rate, respectively.

19. The method of claim 18 wherein the operating of the machine at the first combination of ground speed and working depth and the operating of the machine at the second combination of ground speed and working depth each include rotating a rotor of the machine at the corresponding working depth to mix paving material soil and the dispensed liquid by way of the rotation of the rotor.

* * * * *